United States Patent [19]

Williams

[11] Patent Number: 4,720,232

[45] Date of Patent: Jan. 19, 1988

[54] PARTS HANDLER

[76] Inventor: Robert E. Williams, Rte. 3, Hodgenville, Ky. 42748

[21] Appl. No.: 818,334

[22] Filed: Jan. 13, 1986

[51] Int. Cl.[4] ..... B65G 65/00

[52] U.S. Cl. ..... 414/607; 414/422

[58] Field of Search ..... 414/607, 608, 422, 425, 414/414, 303, 519, 520; 298/19 R, 22 R, 22 B, 22 D, 23 R, 24; 222/517, 166, 536; 193/4, 5, 20, 21

[56] References Cited

U.S. PATENT DOCUMENTS

| | | | |
|---|---|---|---|
| 1,050,983 | 1/1913 | Neiswanger | 193/21 |
| 1,526,527 | 2/1925 | Butler | 298/24 X |
| 1,985,361 | 12/1934 | Anthony et al. | 298/22 B |
| 2,482,692 | 9/1949 | Quales et al. | 414/607 |
| 2,555,406 | 6/1951 | Golay | 298/22 B |
| 3,270,900 | 9/1966 | Sherman | 414/422 X |
| 3,413,032 | 11/1968 | Dendy | 298/24 X |
| 3,613,924 | 10/1971 | Monson | 414/608 X |
| 3,693,774 | 9/1972 | Meitl | 193/5 X |
| 3,877,593 | 4/1975 | Sleziak | 414/422 |
| 4,334,820 | 6/1982 | Homura | 414/422 X |
| 4,405,278 | 9/1983 | Kualheim | 414/414 X |

FOREIGN PATENT DOCUMENTS

| | | | |
|---|---|---|---|
| 556433 | 4/1958 | Canada | 414/414 |

*Primary Examiner*—Joseph E. Valenza
*Assistant Examiner*—David A. Bucci
*Attorney, Agent, or Firm*—Scott R. Cox

[57] ABSTRACT

A parts handler comprising a container with a discharge chute secured to a frame which can be transported by a forklift truck. The discharge chute has a spring hinge type door opened by a pull-down handle. The frame is attached and secured to the bottom of the container by hinges located at the same end of the container as is the discharge chute. The container is raised by an ordinary hydraulic floor jack secured to the frame. The jack raises the container by a caster secured to the arm of the jack which operates within a channel secured to the bottom of the container. By raising the arm of the jack, the end of the container opposite the discharge chute rises and parts are allowed to flow from the container by opening of the door of the discharge chute.

1 Claim, 13 Drawing Figures

PARTS HANDLER

BACKGROUND OF INVENTION

1. Field of Invention

This invention relates to material handling devices and is more particularly concerned with parts handling devices used in the small parts industry, which may be mounted on and conveyed by a forklift type truck.

2. Prior Art

In the distribution and shipping of small parts, it is frequently necessary to transfer quantities of small parts such as nails, bits, screws, etc. from large containers to smaller containers to fill orders for purchasers of those parts or for other similar purposes. In the past, transfer of the parts has been carried out by the manual operation of an individual without using any device specifically designed to assist such distribution. The individual would lift out the parts necessary for the job and transfer them to the smaller container. The larger container might be carried to the smaller container by a forklift type truck. This procedure is inefficient and may be difficult to perform because of the weight and the shape of the small parts.

Material handling containers heretofore known in the art have inherent in their structure several disadvantages which have reduced their efficiency. The prior art devices have not been specifically designed to be used as small parts handlers. Many of them have been useful only for trash removal. For example, many of the material handling containers employ a dumping container which empties the entire contents within the container in a dump-truck type manner without any precise control on the rate of flow of the material contained within. See, for example, U.S. Pat. Nos. 3,881,617, 3,877,593, 3,101,152, and 3,656,643.

Further, the prior art devices have used methods for tilting the container which require special construction of both the container and the receiving box. In U.S. Pat. No. 4,405,278, a container for transporting trash is constructed with a device attached to a dump box which frequently will interact with a specially constructed dumping leg attached to the container to tilt the container and empty the material into the dump box. In U.S. Pat. No. 3,270,900, a lever means is attached to the frame of the container which acts against the side of a dump box to elevate the container and discharge the material contained within the container. In U.S. Pat. No. 4,334,820, the method of dumping the material is a system of cables and stanchions having one or more pulleys attached to the container.

Each of these prior art devices requires a special adaptation apparatus connected to the dump box and/or to the container. These prior art devices are not easily adaptable to the handling of small parts since the small parts must be deposited into shipping boxes which are cheap to construct, nonreusable, and of a standard size, shape and construction.

Accordingly, it is an object of this invention to provide a novel parts handler which will allow for the accurate and easy loading of small parts into boxes for shipping.

A further object of this invention is to provide a novel means for controlling the flow of the parts from a parts handler into the shipping boxes.

Another object of the device is to provide a novel parts handler which is easily transportable by a forklift type truck.

Another object of the invention is to allow for the controlled tilting of a parts handler by means of a hydraulic pressure jack contained and attached to the frame of the parts handler.

Another object of the device is to provide a simple, efficient parts handler that is inexpensive to build, is reusable and is stackable.

Other objects and features of the present invention will become apparent from a consideration of the following description with reference to the accompanying drawings in which a selected example of the construction is set forth to illustrate the invention.

SUMMARY OF THE INVENTION

The instant invention is a parts handler. The container of the parts handler is attached by hinges to a frame. The end of the container has a controllable discharge chute. The parts enclosed within the container are selectively allowed to discharge from the container by means of raising the end of the container opposite the discharge chute and by controlling the opening and closing of a door trough attached to the end of the discharge chute. The raising and lowering of the end of the container opposite the chute is accomplished by any ordinary hydraulic pressure jack. The frame of the parts handler is provided with slots into which the tines of a forklift truck will fit.

BRIEF DESCRIPTION OF THE DRAWINGS

The invention will now be described with reference to the accompanying drawings in which.

DETAILED DESCRIPTION OF THE PREFERRED EMBODIMENT

Figure 7:
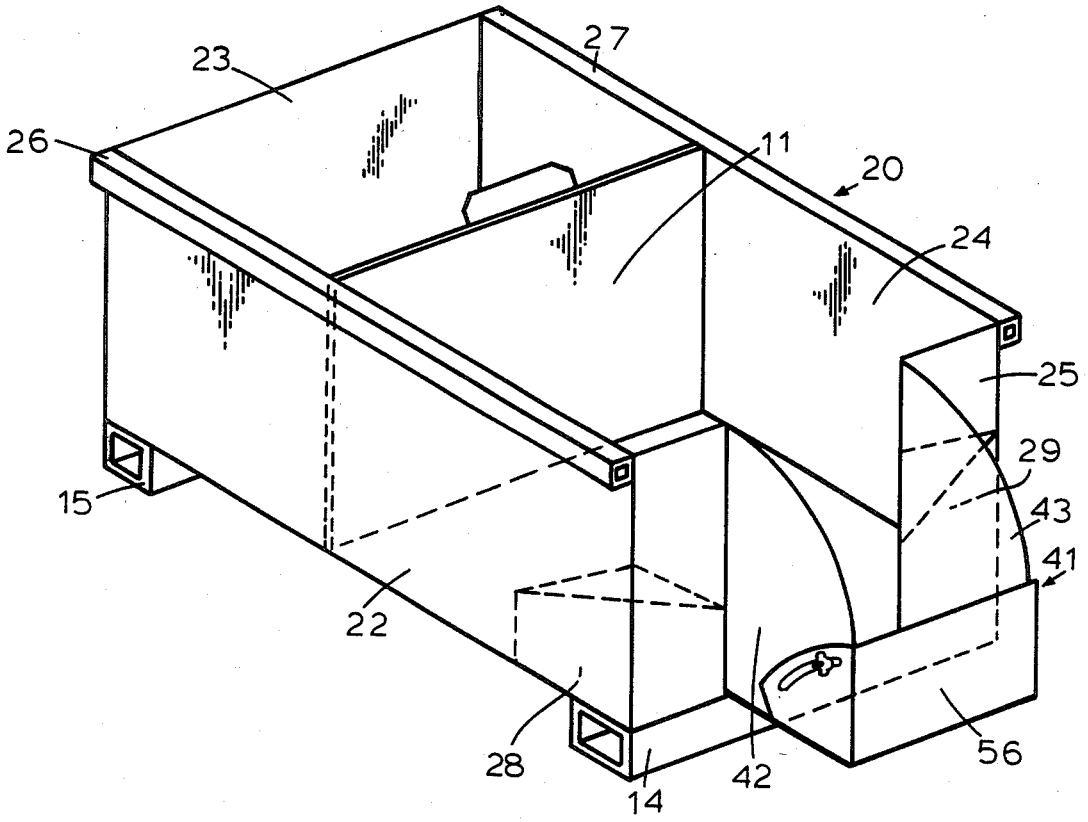
FIG. 7 is a top perspective view of the container of the parts handler showing the divider within the container.
Figure 9:
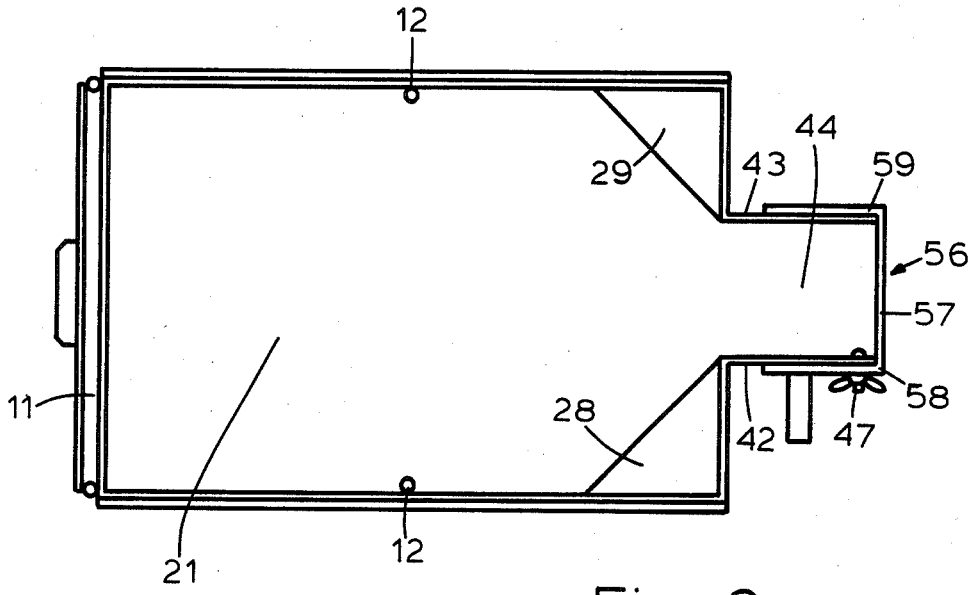
FIG. 9 is a top view of the container showing the door trough of the discharge chute open.

Although the invention is applicable to a wide variety of applications, it is shown in the drawings for the purpose of illustration as embodied in the assembly including a rectangular container (20) having a flat bottom (21) and four vertical sides (22, 23, 24, 25) attached to the bottom and to each other. Each side is rectangular shaped. See FIGS. 7 and 9. The container can be made of any common material such as wood, plastic, fiberglass, steel, aluminum, or any metal. In a preferred embodiment, there are two longer sides (22, 24) and two shorter sides (23, 25). Each of the two longer sides has a small extrusion beam (26, 27) attached to the outer top edge which is useful for stacking purposes.

Figure 2:
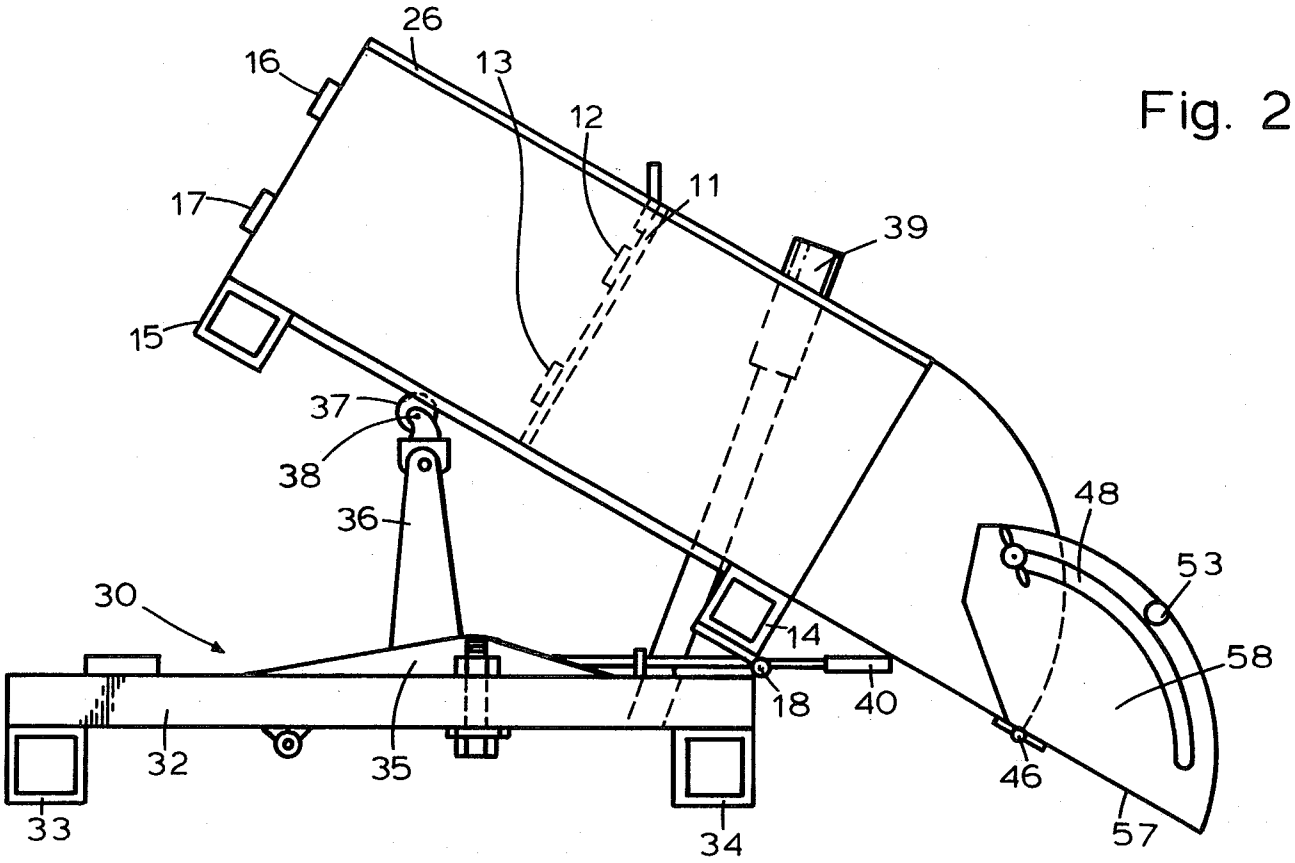
FIG. 2 is a side view of the parts handler with the arm of the hydraulic jack extended and the door trough of the discharge chute open.

One of the two shorter sides (25) has a rectangular shaped opening flush with the bottom of the box and projecting to the top of that side. Connected to this opening is a scoop-type discharge chute (41) through which the parts may leave the container. In a preferred embodiment, the sides of this scoop-type discharge chute (42, 43) are in the shape of one-fourth segment of a circle. The bottom of this discharge chute (44) is rectangular shaped and in the same plane as the bottom of the container. The bottom of the chute is integrally attached to the container to allow the parts to flow freely from the container. Attached to the end of this discharge chute is a door-type trough (56) which prevents the discharge of the parts contained within the container when it is closed (See FIGS. 2 and 9). In a preferred embodiment, this door trough is attached to the bottom lip of the discharge chute (45) by a hinge or hinges (46). The door trough has an end face (57) and sides (58, 59) running perpendicular to the end face projecting toward the container outside the sides (42, 43) of the discharge chute (41). The sides (58, 59) of the door trough (56) are slightly further apart than the sides (42, 43) of the discharge chute and will move in approximately a 90° arc when the door trough (56) is being opened. When the door trough (56) is opened it moves approximately 90° to a position in the same plane as the bottom of the discharge chute and the container. In its closed position, the door trough (56) will prevent the parts from exiting from the container (20).

Figure 1:
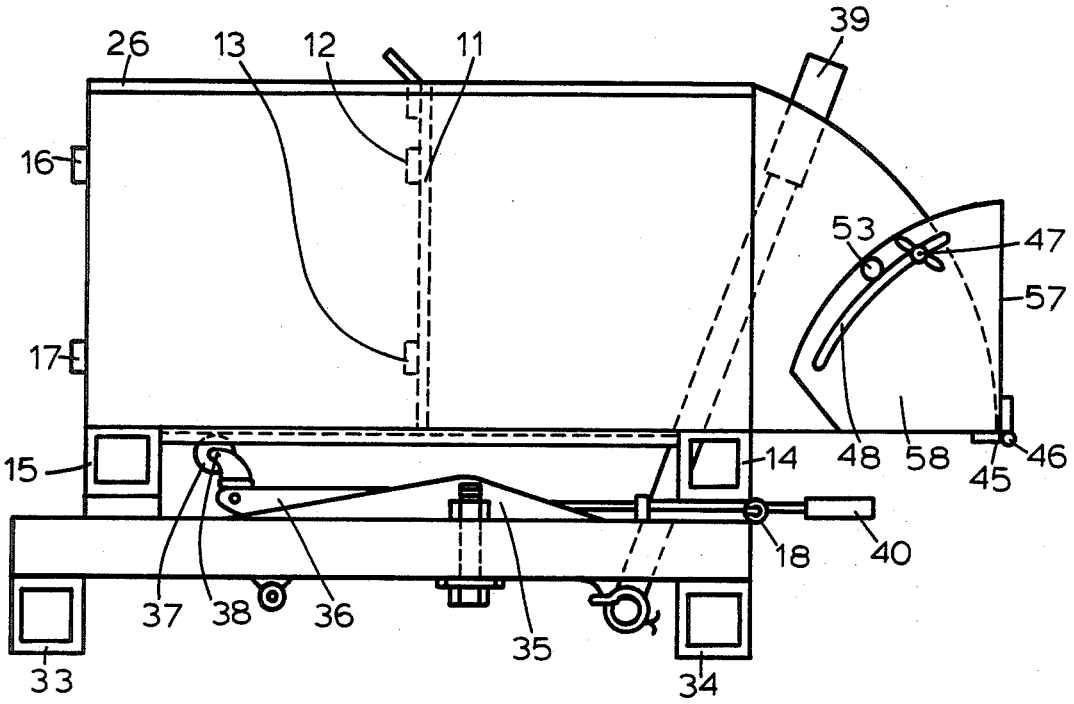
FIG. 1 is a side view of the parts handler including the frame and the container with a discharge chute with its door trough in a closed position.
Figure 11:
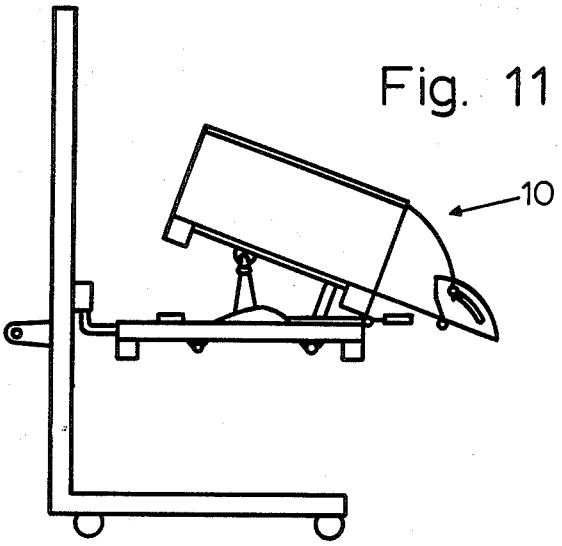
FIG. 11 is a side view of the parts handler with the discharge chute open in use with a forklift truck.

The door trough (56) is prevented from opening further than parallel with the plane of the bottom of the container and the discharge chute (41) by means of a wing nut assembly (47) and arc-shaped slit (48) in the side (58) of the door trough (56). See FIG. 1. The width of the slit (48) is slightly larger than the diameter of a bolt (49) which runs through the slit and is part of the wing nut assembly. See FIG. 11. In a preferred embodiment, the bolt (49) extends through the side (42) of the discharge chute (41) and through the slit (48) at the side of the door trough. A washer (50) and tension spring (51) are placed on the bolt (55) outside of the sides (58, 59) of the door trough. A wing nut (52) is attached to the bolt (55). By tightening the wing nut (52) against the tension spring (51) and washer (50), the door trough (56) is held either closed or opened. A separate wing nut assembly can be used on one or both sides of the discharge chute. The arc slit (48) is limited in length so that the door trough (56) may not be opened more than parallel with the bottom of the discharge chute (41).

Figure 12:
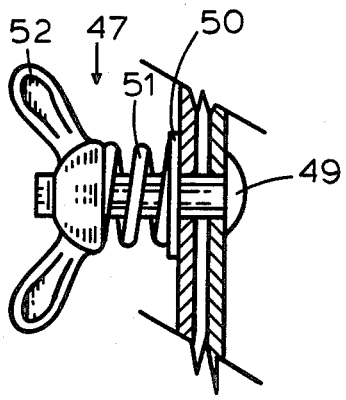
FIG. 12 is a side view of the wing nut assembly.
Figure 13:
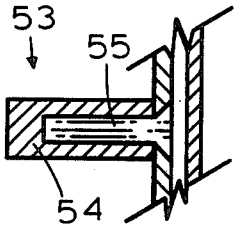
FIG. 13 is a side view of the pull down handle.

Attached to one of the sides of the door trough is a pull-down handle assembly (53). See FIG. 12. The pull down handle assembly can be of any common construction and can be attached by any common method. In a preferred embodiment the pull-down assembly comprises a plastic knob (54) attached to a bolt (55) running through the side of the door trough (52). The knob (54) is located at a convenient place on the side to pull the door trough down. Attached to this pull-down handle may be a cord, wire or chain which can be pulled to open the door trough. In a preferred embodiment, the hinge (46) on the door trough attached to the discharge chute (41) can have a spring 60 attached to it which will, upon release of pressure from the pull-down handle (53), return the end face (57) of the door trough (56) to a closed position preventing further discharge of parts from the container.

Two right triangular shaped wedges (28, 29) are attached to the inside corners of the container near its opening to act as a funnel in the discharge of parts from the container. See FIG. 9. Each wedge is sloped to the rear of the container at an angle of about 30 to about 60° measured from the side of container with the discharge chute. One of the points of the wedge meets the side of the container at the opening of the discharge chute. The other point of the wedge is attached to one of the longer sides of the container. See FIG. 7. The height of the wedges (28, 29) may be of any height helpful in funneling the parts up to the height of the sides of the container (20). The top of the wedges slope downward about 15° to 45° to assist the funneling effect.

The container may be divided into two or more sections by a divider (11) or dividers secured to the walls of the container. The divider (11) may be secured to the walls by divider mounting brackets (12, 13) of any normal. See FIGS. 7 and 9. In a preferred embodiment, two brackets (12, 13) are mounted above each other on each of the longer sides of the container. These brackets are used to mount a divider (11) within the container to keep separate different types of parts. The brackets (12, 13) may be of any common type such as eyelet brackets. The dividers have corresponding mounting bracket slots which will fit inside the eyelet brackets (12, 13). The divider or dividers are removable so that one type of part may be contained within the entire container. In a preferred embodiment, the divider (11) is as long as the inner width of the container and as tall as the sides of the container. On the outside of the side of the container, opposite the opening, are storage brackets (16, 17) of any common type in which the dividers may be stored. See FIGS. 1 and 9.

Figure 5:
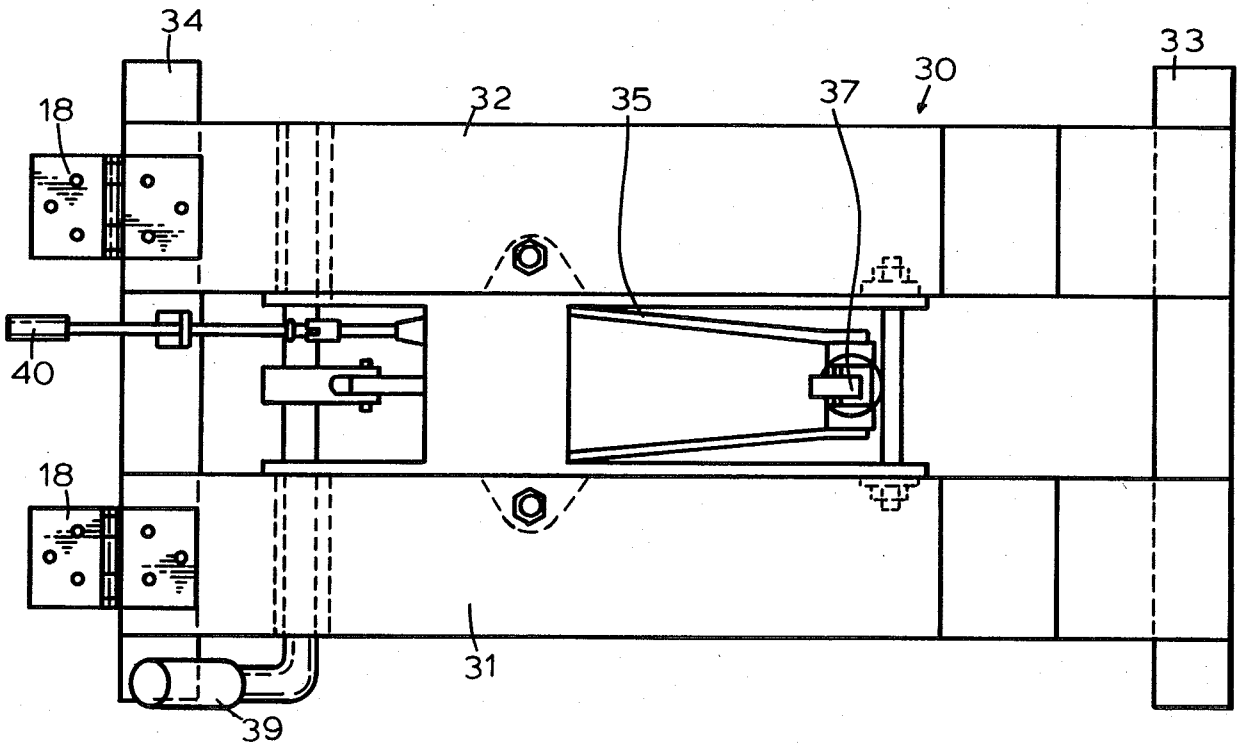
FIG. 5 is a top view of the frame with the front of the frame to the left.
Figure 6:
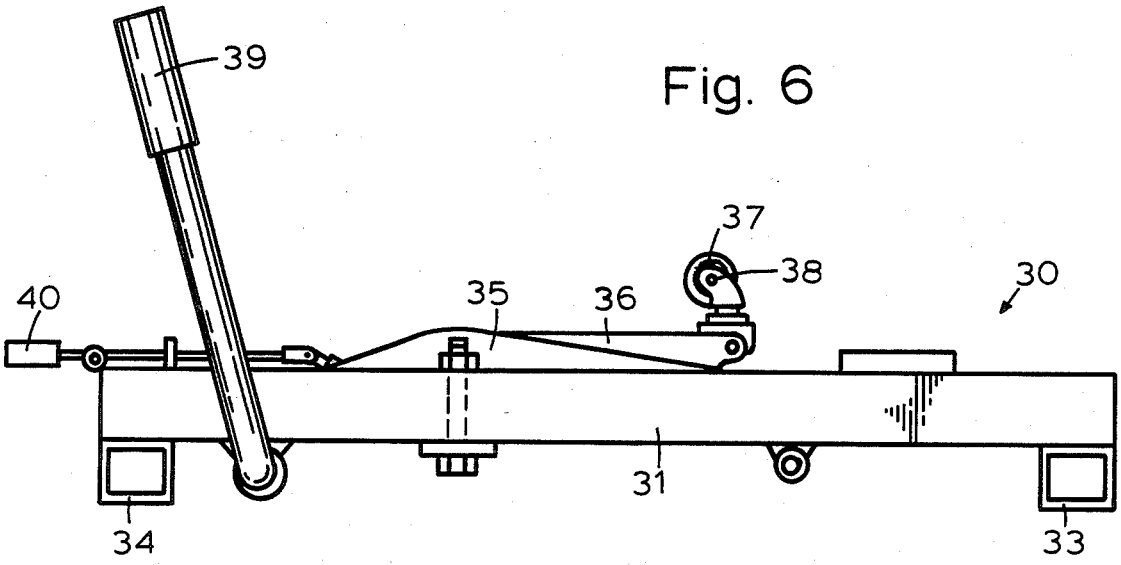
FIG. 6 is a side view of the frame with the front of the frame to the left.

The container is attached to the frame by a hinge (18) or hinges which are attached to an extrusion beam (14) running the bottom width of the container. The extrusion beam is attached to the bottom outside edge of the container at the end of the container with the discharge chute (41). An extrusion beam (15) of the same size is also attached to the other bottom end of the container. The hinges are attached to the extrusion beams by any normal methods, such as screws, bolts or welding. The hinges are attached to the frame by securing them by any normal method, such as screws, bolts or welding, to common rectangular extrusion beams (31, 32) made of any common material such as plastic or metal. These beams are hollow and are of sufficient size to allow the tines of a forklift truck to be inserted into them. These beams (31, 32) are approximately the same length as the container and are secured to each other by crossbeams (33, 34). The crossbeams (33, 34) are secured below the slotted beams (31, 32) at each end of the slotted beams. These crossbeams (33, 34) can be of any extrusion-type beam of any common material such as steel or wood and are secured to the slotted beams by any normal method such as screws, bolts or welding. These crossbeams are generally the same length as the container is wide. See FIGS. 5 and 6.

Secured to the frame between the two slotted beams is a means for elevating the end of the container. In a preferred embodiment this means is an hydraulic floor jack (35) of any common type familiar to those skilled in the art. The jack (35) is secured to the slotted beams (31, 32) by any common methods such as being directly secured to the beams by bolts or welding. See FIG. 5.

Figure 3:
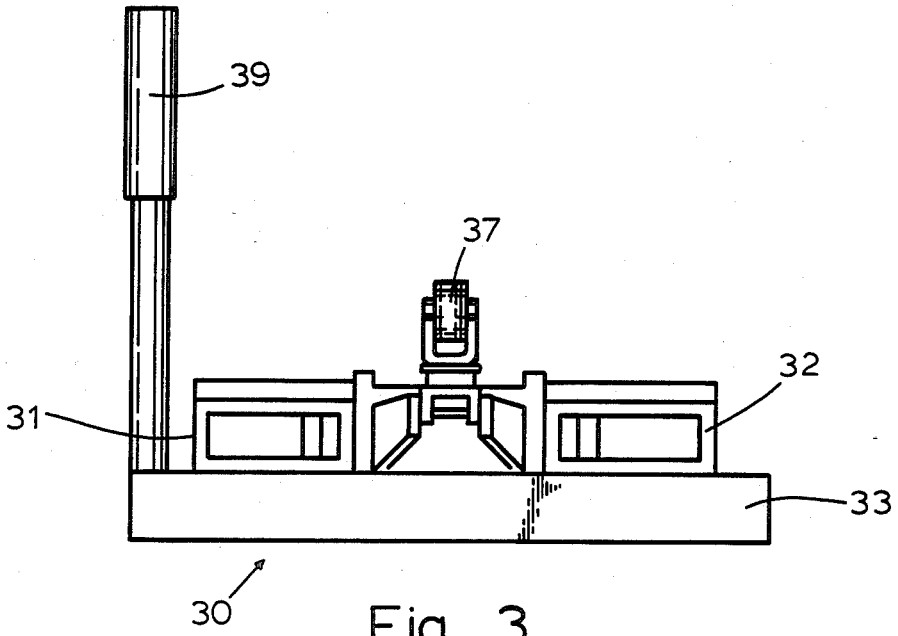
FIG. 3 is a rear view of the frame showing the slots for the insertion of the tines of the forklift.
Figure 4:
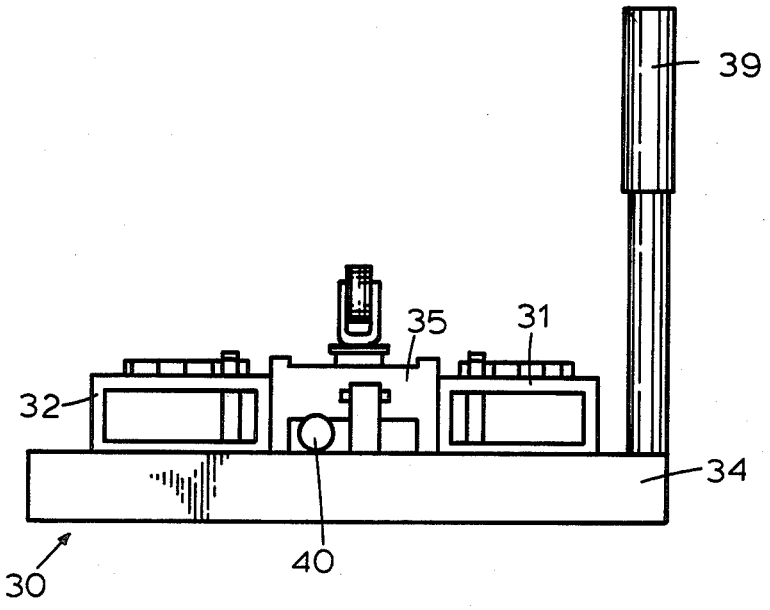
FIG. 4 is a front view of the frame.

The arm of the hydraulic jack (36) elevates the end of the container opposite the discarge chute (41). See FIG. 2. In a preferred embodiment, a freely rotatable caster (37) is secured to the end of the arm of the hydraulic jack by an axle (38) which is attached to the end of the arm. See FIGS. 3, 4 and 5.

Figure 8:
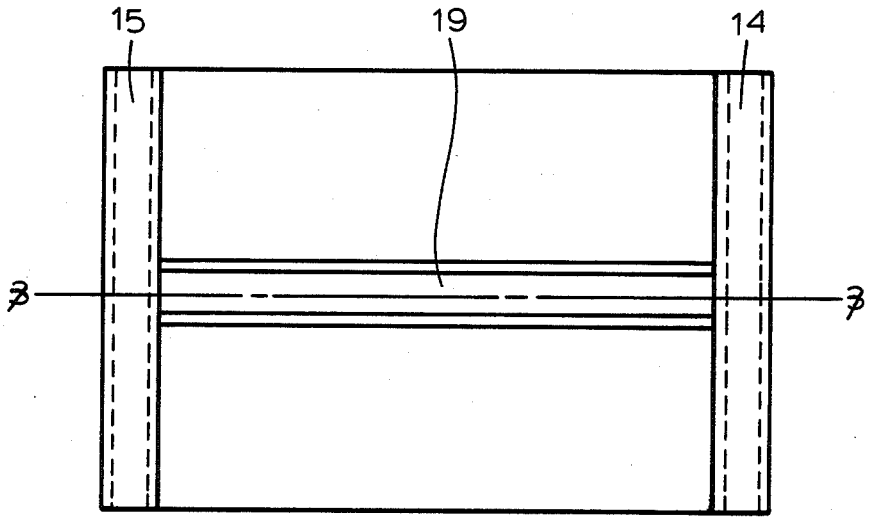
FIG. 8 is a bottom view of the container showing the channel in which the caster attached to the end of the arm of the hydraulic jack moves.

Secured to the bottom of the container is a U-shaped channel (19) of sufficient width to allow the caster (37) to roll within the channel (19) as the arm of the jack moves. See FIG. 8. The channel may be formed from any conventional material, such as aluminum or steel, and is secured to the bottom of the container by any well-known securing method, such as by bolts or welding. The hydraulic jack (35) with its caster (37) is secured to the frame in such a location as to allow the caster to roll within the channel (19) as the arm of the jack is raised. In a preferred embodiment, the channel is located parallel to the longer sides (22, 24) of the container and approximately midway between the two longer sides. The jack (35), with its attached caster (37), is located in such a fashion that as the arm of the jack rises, the caster (37) will move within the channel (19) and raise the end of the container away from the discharge chute (41). This creates a dump truck-like effect on any parts of other material within the container. When the end of the container is raised, the parts will move toward the discharge chute (41).

The hydraulic jack (35) contains any well-known means for raising the jack, such as an ordinary hand crank (39), as well as any well-known means for lowering the jack, such as an ordinary hydraulic pressure release handle (40). The crank (39) and the handle (40) are readily accessible to the operator of the parts handler. See FIGS. 1 and 2.

The frame of the parts container is constructed in such a manner that the parts containers can be stacked for storage purposes. As previously mentioned, the lip of the longer sides of the container have square extrusion beams (26, 27) attached to them which are useful for storage purposes. Also, the frame is constructed in such a fashion that the bottom support for the frame is the same width as the container. Since the hydraulic jack does not project through the frame below the supporting beams, it is practical to stack the containers one on top of the other for storage purposes.

Figure 10:
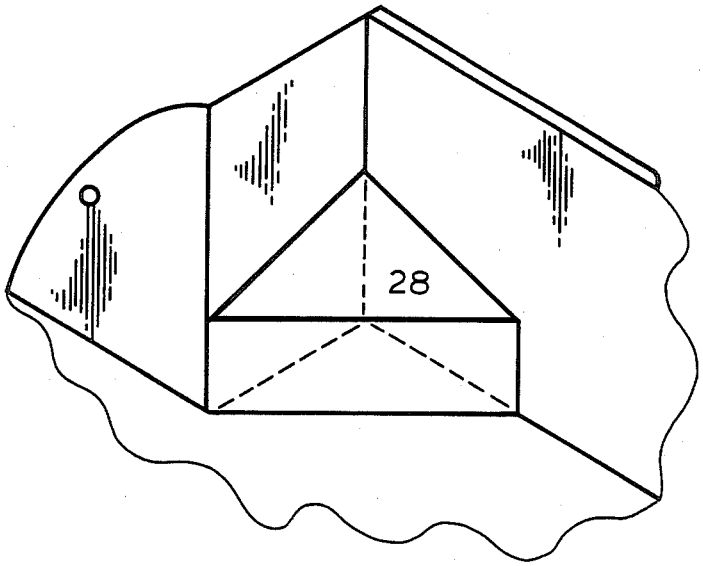
FIG. 10 is a top perspective view of the triangular shaped wedge attached to the inside corner of the container.

In operation, the operator will secure one of these parts handlers on a forklift by inserting the tines of the forklift into the slots in the frame. See FIG. 10. The door on the discharge chute of the parts handler will at this time be closed. The operator may place within the container a divider if the operator wishes to distribute more than one type of part. The parts may be poured into the parts handler while attached to the forklift. The parts handler is then moved to the designated location for discharge of the parts to fill an order. Once the parts handler is properly located at the discharge point, the hydraulic jack raises the end of the container opposite the discharge chute. The door at the end of the discharge chute is then opened by the pull-down handle. The door may be held open by securing the wing nut or nuts to the side of the discharge chute. The parts are then allowed to flow from the container by means of gravity and by the assistance of the operator. Once sufficient parts are removed from the container, the door is closed and the hydraulic pressure release handle is pulled. By the release of the hydraulic pressure, the container reverts to a horizontal position and can be moved to the next discharge point.

I claim:

1. A parts handler for handling small parts for operation with a forklift comprising a container having a flat bottom, two longer sides and two shorter sides attached to the flat bottom and to each other; one of those shorter sides having a discharge chute for the selective discharge of small parts which is secured to an opening in that shorter side, the bottom of said discharge chute being flush with the flat bottom of the container and the sides of said discharge chute inset from the longer sides of the container and extending outward from that side wall of the container, a door trough with adjustable side walls secured to the sides of the discharge chute by a slotted arc in the side walls of the door trough, and a bolt and wing-nut assembly; and attached to the container is a frame comprising parallel slotted beams into which the tines of a forklift will fit, crossbeams attached to the slotted beams at or near the opposite ends of the slotted beams and an hydraulic jack with a rotatable caster at the end of the arm of the hydraulic jack, the caster rotating within a channel secured to the bottom of the container and located in such a fashion that when the arm of the hydraulic jack rises, the end of the container opposite the discharge chute will also rise.

* * * * *